US009903387B2

(12) United States Patent
Stagg et al.

(10) Patent No.: US 9,903,387 B2
(45) **Date of Patent: *Feb. 27, 2018**

(54) RING FAN AND SHROUD ASSEMBLY

(71) Applicants: Jonathan B. Stagg, Bellevue, MI (US); James W. Bailey, Marshall, MI (US)

(72) Inventors: Jonathan B. Stagg, Bellevue, MI (US); James W. Bailey, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 694 days.

This patent is subject to a terminal disclaimer.

(21) Appl. No.: 13/751,096

(22) Filed: Jan. 27, 2013

(65) Prior Publication Data

US 2014/0212291 A1 Jul. 31, 2014
US 2016/0177967 A9 Jun. 23, 2016
US 2017/0138369 A9 May 18, 2017

Related U.S. Application Data

(63) Continuation of application No. 12/594,017, filed as application No. PCT/US2008/059515 on Apr. 5, 2008, now Pat. No. 8,475,111.

(60) Provisional application No. 60/910,271, filed on Apr. 5, 2007.

(51) Int. Cl.
*F04D 29/32* (2006.01)

(52) U.S. Cl.
CPC ..... *F04D 29/326* (2013.01)

(58) Field of Classification Search
CPC .... F04D 29/162; F04D 29/281; F04D 29/326; F04D 29/441; F04D 17/06
USPC ..... 415/1, 54.1, 57.1, 57.3, 57.4, 58.5, 58.6, 415/58.7, 173.1, 173.6, 208.3, 220, 222; 416/189
See application file for complete search history.

(56) References Cited

U.S. PATENT DOCUMENTS 4,357,914 A 11/1982 Hauser
4,566,852 A * 1/1986 Hauser ..... 415/220
4,871,294 A * 10/1989 Ivanov ..... F01D 11/08 415/58.4
5,282,718 A * 2/1994 Koff et al. ..... 415/57.3
(Continued)

FOREIGN PATENT DOCUMENTS

JP S63-26798 2/1988
JP 2004027919 A 1/2004
(Continued)

*Primary Examiner* — Jason Shanske
*Assistant Examiner* — Jesse Prager
(74) *Attorney, Agent, or Firm* — Harness, Dickey & Pierce, P.L.C.; John A. Artz, PC

(57) ABSTRACT

A ring fan and shroud assembly having a fan, a shroud member, a recirculating flow member, and a plurality of curved guide vanes. The fan has a hub with a plurality of projecting fan blades and an outer ring member. The shroud member is positioned around the outer ring member. The recirculating flow member is on the shroud member and is positioned forward adjacent the outer ring member. The guide vanes are positioned within the recirculating flow member and define an inlet angle, which is nearly tangential with an outer entry diameter radial surface of the recirculating flow member, and an outlet angle that is nearly radial along an inner exit diameter of the recirculating flow member.

15 Claims, 5 Drawing Sheets

(56) References Cited

U.S. PATENT DOCUMENTS

| | | | | |
|---|---|---|---|---|
| 5,489,186 | A * | 2/1996 | Yapp et al. | 415/58.7 |
| D446,295 | S | 8/2001 | Williams et al. | |
| 6,302,650 | B1 | 10/2001 | Williams et al. | |
| 6,343,915 | B2 | 2/2002 | Williams et al. | |
| 6,375,427 | B1 | 4/2002 | Williams et al. | |
| 6,565,320 | B1 | 5/2003 | Surls et al. | |
| 6,599,088 | B2 | 7/2003 | Stagg | |
| 6,827,547 | B2 | 12/2004 | Robb | |
| 7,168,922 | B2 | 1/2007 | Stagg et al. | |
| 7,789,622 | B2 * | 9/2010 | Acre | 415/209.3 |
| 7,789,628 | B2 | 9/2010 | Stagg et al. | |
| D633,195 | S | 2/2011 | Stagg | |
| D634,833 | S | 3/2011 | Stagg | |
| 8,454,300 | B2 * | 6/2013 | Stagg et al. | 415/58.5 |
| 2011/0044809 | A1 * | 2/2011 | Stagg et al. | 415/208.2 |

FOREIGN PATENT DOCUMENTS

| | | | |
|---|---|---|---|
| JP | 2004107757 | A | 4/2004 |
| JP | 2004316448 | A | 11/2004 |
| WO | WO-/1998/045601 | A1 | 10/1998 |

* cited by examiner

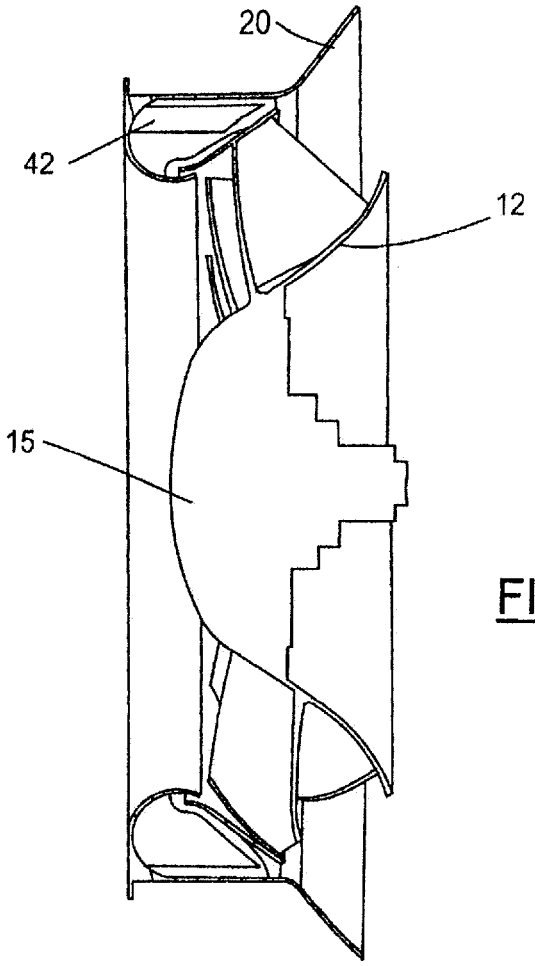
FIG. 5
FIG. 8
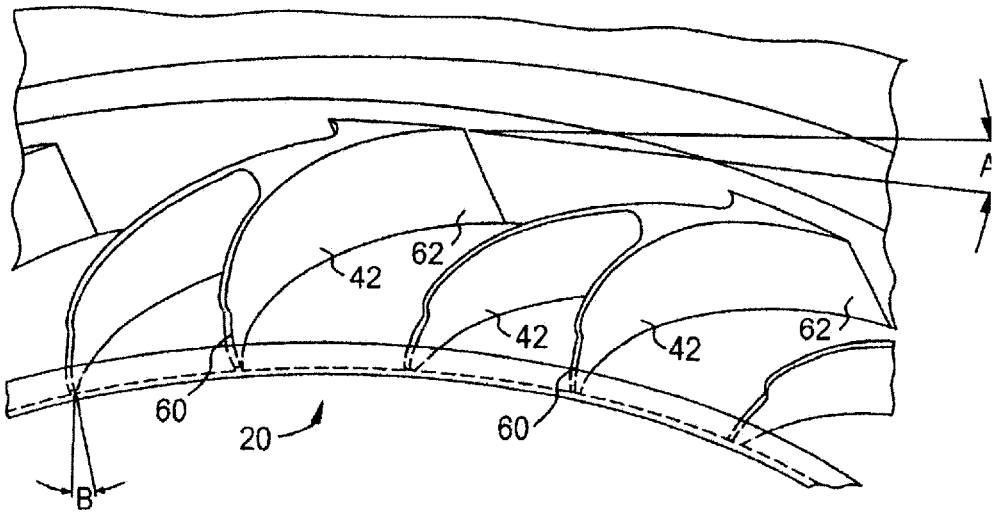

RING FAN AND SHROUD ASSEMBLY

CROSS-REFERENCE TO RELATED APPLICATIONS

This is a continuation of U.S. application Ser. No. 12/594,017, filed Sep. 30, 2009 (now U.S. Pat. No. 8,475,111 issued on Jul. 2, 2013), which is a national phase entry of PCT/US2008/059515, filed Apr. 5, 2008, which claims the benefit of U.S. Provisional Patent Application Ser. No. 60/910,271, filed Apr. 5, 2007.

TECHNICAL FIELD

The present invention relates generally to a ring fan and shroud assembly and more particularly to a ring fan and shroud assembly with improved air flow characteristics.

BACKGROUND OF THE INVENTION

Axial type fans move air, or other fluids, using rotating impeller blades. As the impeller blades rotate, different pressures on opposite sides of the blades are developed. The discharge sides of the impeller blades typically develop a high pressure while the intake sides develop a low pressure. The pressure differential between these two sides causes the fluid to flow from the high-pressure discharge side to the low-pressure intake side near the tips of the impeller blades creating an undesirable back flow of some of the fluid flow passing through the fan. It is well-known that this backflow can decrease the efficiency of the fan and may lead to undesirable noise generation.

Engine cooling fans develop static pressure across the fan such that the regions ahead of the fan are at significantly lower pressure than regions behind the fan. Many engine cooling fans have cowlings or shrouds positioned circumferentially around them in order to assist in directing the air flow in the desired direction. Practical operation of fans used in motor vehicle cooling systems dictate minimum clearances between the rotating fan members and stationary shroud members in order to ensure safe, durable functioning throughout the life of the vehicle.

Many of the cooling fan members used in such systems are ring-type fans, i.e. the fans have a circumferential ring member positioned on the tips of the fan blades. The pressures developed across the cooling fans drive leakage flow through the gaps occurring between the fan's blade tips or any rotating ring, and the stationary surfaces of the shroud.

In ring fans, the leakage flow encounters the tip gap at the trailing edge of the rotating ring and enters the gap region having a very high tangential velocity component. As the leakage flow progresses through the gap region, the viscous drag of the rotating ring continues to strengthen this vortical flow until finally it reaches the exit of the gap region, which is just upstream of the tips of the blades of the fan.

When the recirculating leakage flow reenters the main fan air flow passage, it possesses a very high tangential component, which is at odds with the velocity and direction of the primary incoming air flow of the fan. As the tangentially-oriented recirculating flow mixes with the passage of the primary air flow which is mostly axial, a vortex is formed adjacent the front of the leading edge at the tips of the fan blades. Since the leading edges of fan blades are designed for the primary flow velocity condition, the vortex encountered by the blades is misaligned relative to the intended inlet vector. This can cause the tip region to stall and the resulting low relative-momentum flow can "hang up" in the region of the blade tips and fan ring. This reduces the air flow rate of the fan, as well as its static pressure, and also increases the drag.

It would therefore be desirable to have a ring fan and shroud assembly that was effective in reducing these complications. It would further be desirable to minimize or eliminate the tangential velocity component prior to reinducing the leakage flow back into the primary air stream flowing through the fan. It would further be desirable to minimize the tip gap leakage flow and prevent tip stall.

SUMMARY OF THE INVENTION

It is, therefore, an object of the present invention to provide a ring fan and shroud assembly which minimizes the tip gap leakage flow and prevents tip stall. It is a further object of the present invention to provide a ring fan and shroud assembly with improved efficiency and reduced noise generation.

It is an additional object of the present invention to provide a ring fan and shroud assembly in which the shroud and guide vanes can be easily formed in a conventional two-piece mold injection molding process In accordance with the objects of the present invention, a ring fan and shroud guide assembly is provided. The fan assembly includes a plurality of impeller blades positioned within and attached to a conical outer ring. A portion of the stationary shroud member can overlap radially inwardly a portion of the fan's rotating ring. The shroud member and ring member form an annular recirculation nozzle adjacent the primary inlet air flow passage of the fan. A plurality of curved guide vanes are provided in the shroud member which act on the back flow of air entering the tip gap. The axially extending guide vanes have a substantially tangential leading edge orientation which align with the air flow entering the air gap. The curved guide vanes minimize or eliminate the tangential velocity component of the back flow air stream prior to reinducing that leakage flow back into the air stream through the recirculation nozzle.

The tip-gap has an entrance area substantially larger than the area of the recirculation nozzle. This, together with a converging exit region increases the velocity of the air flow injection of the leakage flow back into the fan's air stream.

Other features, benefits and advantages of the present invention will become apparent from the following description of the invention, when viewed in accordance with the attached drawings and appended claims.

BRIEF DESCRIPTION OF THE DRAWINGS

FIG. 5 is a cross-sectional view of the ring fan and shroud assembly as shown in FIG. 4, the cross-section being taken along lines 5-5 in FIG. 4.

FIGS. 8 and 9 illustrate an embodiment of the guide vanes in accordance with the present invention.

DESCRIPTION OF PREFERRED EMBODIMENTS

Figure 1:
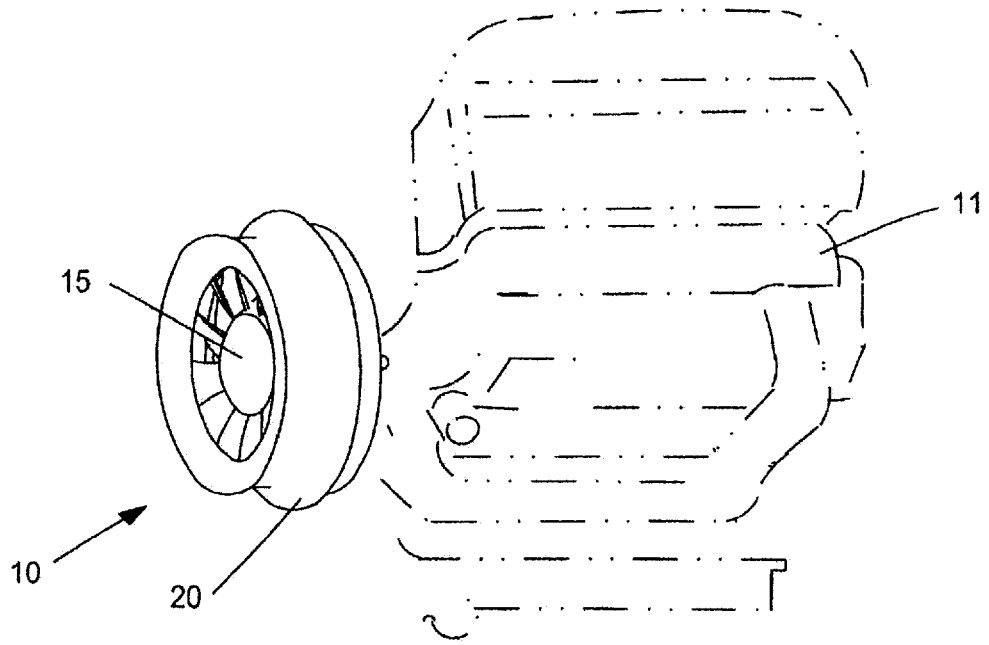
FIG. 1 is a schematic view of a vehicle engine having a cooling system according to a preferred embodiment of the present invention.
Figure 2:
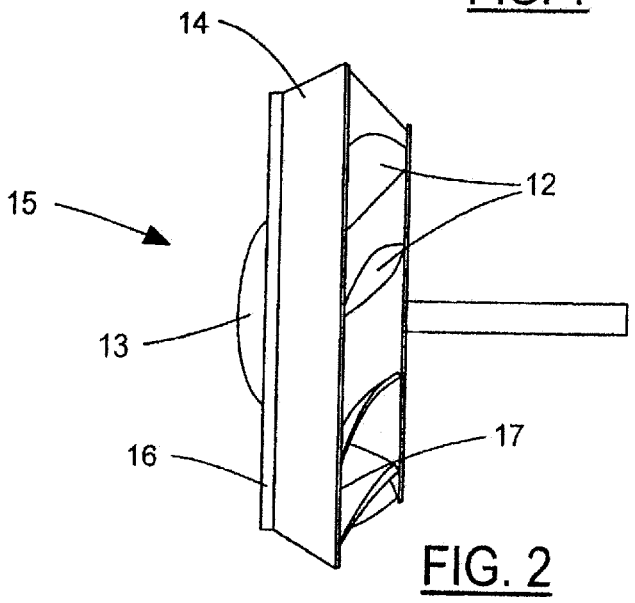
FIG. 2 illustrates a fan assembly in accordance with a preferred embodiment of the present invention.
Figure 3:
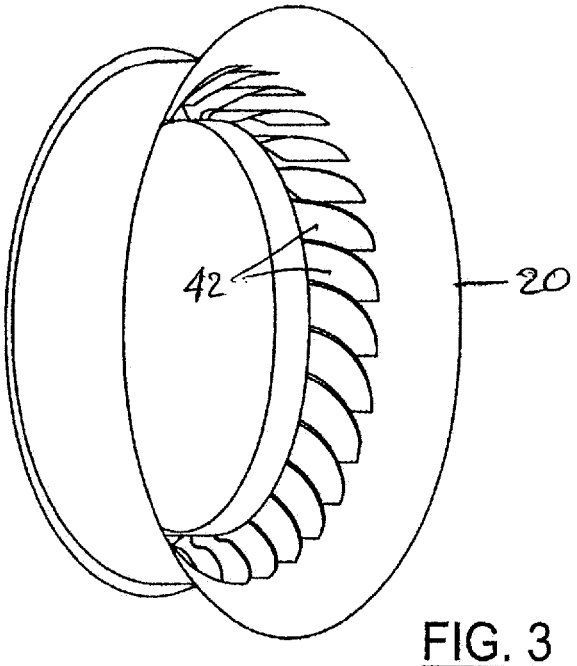
FIG. 3 illustrates a shroud member in accordance with a preferred embodiment of the present invention.
Figure 4:
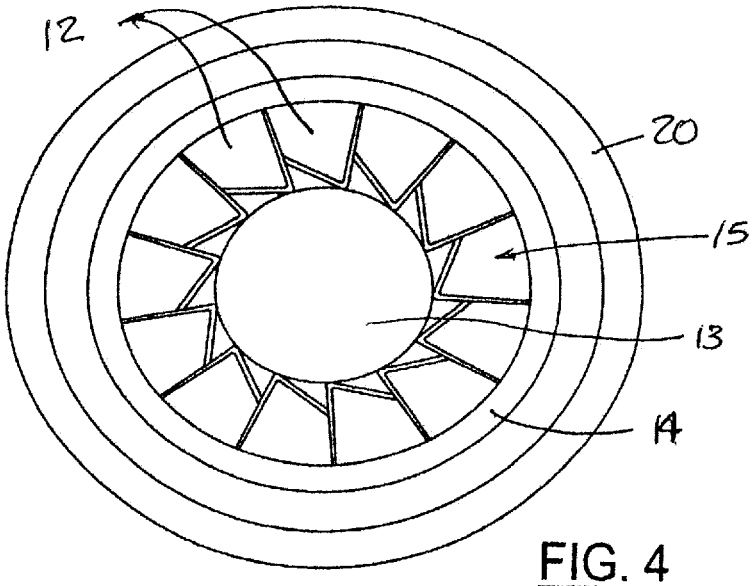
FIG. 4 shows a ring fan and shroud assembly in accordance with a preferred embodiment of the present invention.
Figure 6:
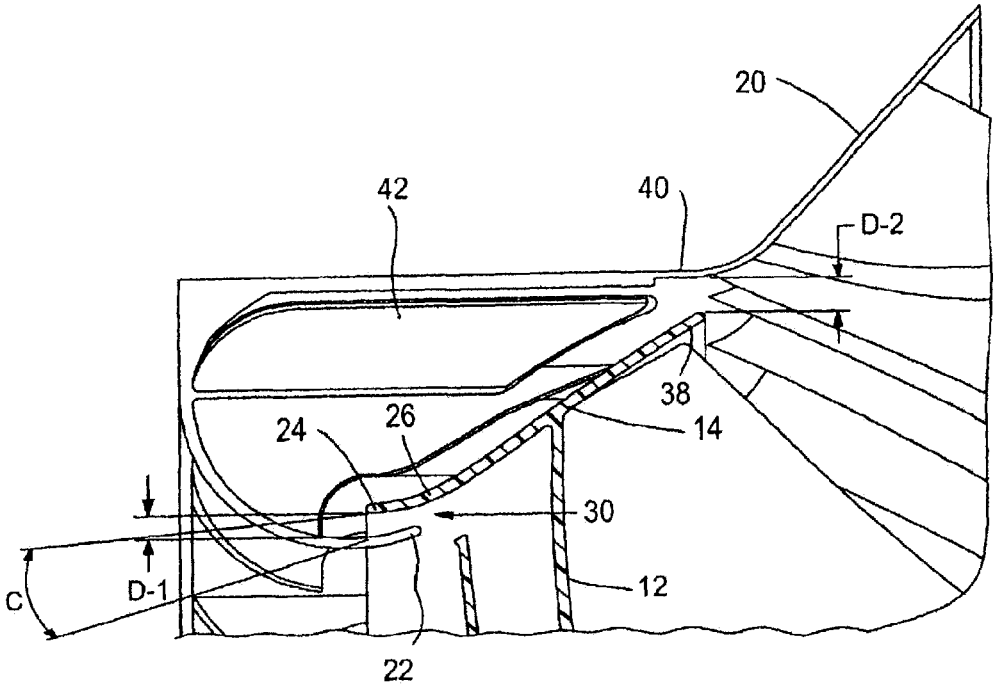
FIG. 6 is an enlarged view of a portion of the ring fan and shroud assembly cross-section as shown in FIG. 5.

FIG. 1 illustrates a ring fan and shroud assembly 10 constructed in accordance with the teachings of the present disclosure. Although it is contemplated that the ring fan and shroud assembly 10 can be used in a variety of applications, the ring fan and shroud assembly 10 of the particular example shown in the drawings and described herein is employed with a radiator cooling system in a truck or other vehicle. It is to be understood, however, that the present teachings can be used in many applications, and that the present teachings are not to be limited only to trucks or other vehicles.

The ring fan and shroud assembly 10 can include a fan member 15 and a shroud member 10. The fan member 15 has a central hub member 13, a plurality of blade members 12 (also called "impeller" members) and a circumferential outer ring member 14 that is positioned at and connected to the ends (or tips) of the blade members 12. The use of impeller blades and a rotating ring element to form a fan assembly is well known in the art, and these fans assemblies are commonly referred to as "ring fans".

While the fan member 15 of the present example is illustrated and described as having a solid, complete annular outer ring member 14 that is positioned at the tips of the blade members 12, it is also possible that the outer ring member 14 (or discontinuous portions thereof) can be positioned radially inwardly slightly from the ends of the blade members 12.

The outer ring member 14 can be integrally formed with the remainder of the fan member 15 and thus can be fixedly attached to the tips of the blade members 12. The outer ring member 14 can have a frusto-conical shape, as shown in the drawings. The outer ring member 14 has a smaller diameter at the air inlet or low pressure side 16 of the fan member 15 and a larger diameter at the air discharge side, or high pressure side 17 of the rotating fan member 15.

The shroud member 20 is cylindrical in shape and is positioned circumferentially around, or substantially circumferentially around, all or a principal portion of the rotating fan member 15.

The shroud member 20 also has a portion or component 22 that is positioned radially inward of a leading edge 24 of the outer ring member 14 and axially overlaps a corresponding portion 26 of the outer ring member 14. The portion 26 is spaced a radial distance D-1 from the outer ring member 14 and forms a nozzle 30 with an annular cross-sectional area. This nozzle 30 is called the "recirculation nozzle" as it re-injects into the primary fan air stream 32 the back flow of air 34 that enters into the tip gap 36 (defined below).

A trailing edge 38 of the outer ring member 14 and a second portion or surface 40 of the shroud member 20 are spaced apart by a radial distance D-2. The radial space between the trailing edge 38 of the outer ring member 14 and the surface 40 of the shroud member 20 is referred to as being a tip gap 36—or tip gap region—and is the area where a portion of the air flow (see arrows 34 in FIG. 7) flows back in the opposite direction of the main air flow of the fan member 15. The tip gap 36 also has an annular cross-sectional area.

The distance D-2 is larger than the distance D-1, and similarly the annular cross-sectional area of the tip gap region 36 is larger than the annular cross-sectional area of the recirculation nozzle 30. Preferably, the distance D-2 is substantially larger than distance D-1, by 50% or more.

A plurality of guide vanes 42 are provided in the shroud member 20. The space in between the guide vanes 42 may be varied to modify the frequency of pressure pulses relative to a point on the fan member 15 as it proceeds through a full revolution in an effort to reduce fan noise and vibration (NVH). The number of guide vanes 42 as well as the number of blade members 12 also preferably correspond with a prime numbering system in order to help reduce NVH. In this regard, one possible ring fan and shroud assembly can have thirteen blade members 12 and thirty-one guide vanes 42.

Figure 7:
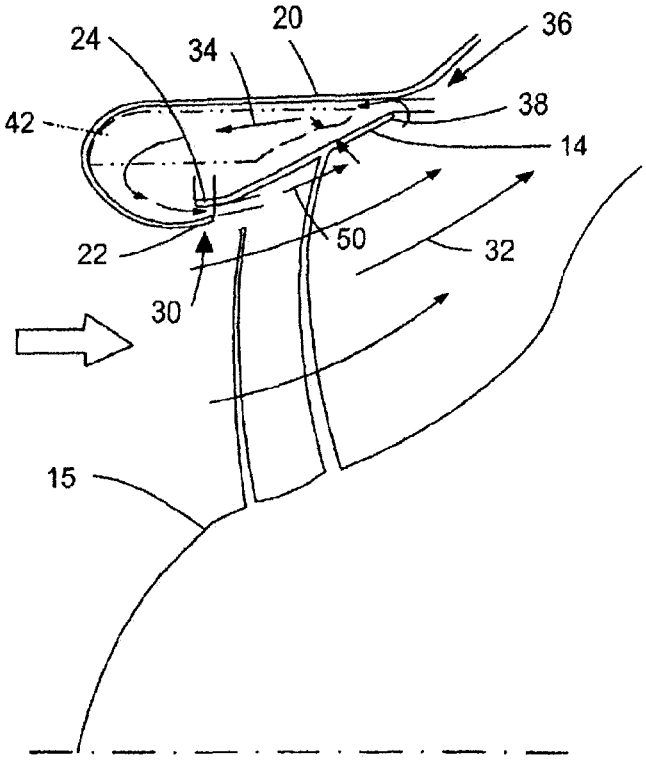
FIG. 7 is an illustration similar to FIG. 6 and showing the components and air flows in a schematic manner.

As noted above, the shroud member 20 forms a recirculation nozzle 30 which defines a flow passage adjacent to the primary incoming flow stream. The larger entrance area of the tip gap region 36 in conjunction with a converging exit region of the area of the recirculation nozzle 30 effectively provides high velocity injection of the leakage air flow (i.e., the back flow) back into the fan air stream. This also minimizes the tip gap leakage flow. The tip gap leakage flow 50 and the upstream primary flow 32 are merged together and align with each other as shown in FIG. 7. This is in proper incidence with respect to the leading edge angle of the tip of the blade members 12 near the outer ring member 14.

Also, the high velocity tip gap leakage flow 50 that re-enters the tip air stream of the fan member 15 through the reduced area in the nozzle 30 utilizes the Coandă effect to stay attached to the rotating outer ring member 14. This helps to energize the low relative momentum flow existing in the blade tip/rotating ring region and prevents tip stall.

The guide vanes 42 preferably have a curved configuration. As shown in FIG. 8, the guide vanes 42 also have substantially tangential leading edges 62 (i.e., each of the leading edges 62 is substantially tangential to an annular portion of the shroud member 20 at a point at which the leading edge 62 intersects the shroud member 20), which initially direct and orient the air flow entering the tip gap region 36, and have substantially radial trailing edges 60 (i.e., each of the trailing edges 60 is oriented substantially toward a rotational axis of the fan member 15) that are adjacent the recirculation nozzles 30. The guide vanes 42 minimize or eliminate the tangential velocity component of the air flow as it passes through the shroud member 20 and prior to introduction of the leakage flow back into the air stream flowing into the fan member 15.

It is also possible for the shroud member 20 to have guide vanes 42 that have configurations that are different from that which is depicted in the drawings and described herein.

The guide vanes 42 on the shroud member 20 smoothly "capture" the leakage flow as it enters the tip gap region 36. This is aided by the substantial tangential leading edge 62 of the guide vanes 42, along with the substantially radial trailing edge 60 of the guide vanes 42. Configuration in this manner gently turns the flow direction from tangential to radial and axial. A meridional air flow is created as the guide vanes 42 effectively remove the tangential component from the recirculation flow. A meridional air flow is one having only radial and axial velocity components without a tangential component present.

The introduction of the recirculation flow at high velocity energizes the low relative momentum fluid and utilizes the Coandă effect to help keep the primary flow attached to the surface of the rotating outer ring member 14. The Coandă effect is a well-known aerodynamic effect discovered in 1930 by Henri-Marie Coandă. Coandă observed that a stream of air emerging from a nozzle tends to follow a nearby surface as long as the curvature or angle of the surface does not vary sharply from the flow direction. The present teachings employ this effect since the flow emerging from the recirculation nozzle 30 is directed along the inner surface of the rotating outer ring member 14, helping to prevent tip stall. Additionally, in one embodiment, air flows past the discharge surface and along the shroud exit surface without recirculating back through the tip gap 36.

In one embodiment, the shroud exit element is substantially parallel and coincident with the trailing edge 38 of the rotating outer ring member 14. The decrease in flow area between the tip gap region entrance and exit, and the converging nature of the nozzle 30 promote acceleration of the flow as it reenters the fan passage. This promotes a significant pressure drop across the nozzle 30 which in turn improves the capacity of the fan member 15 to sustain high static pressure differential across the fan member 15.

Figure 9:
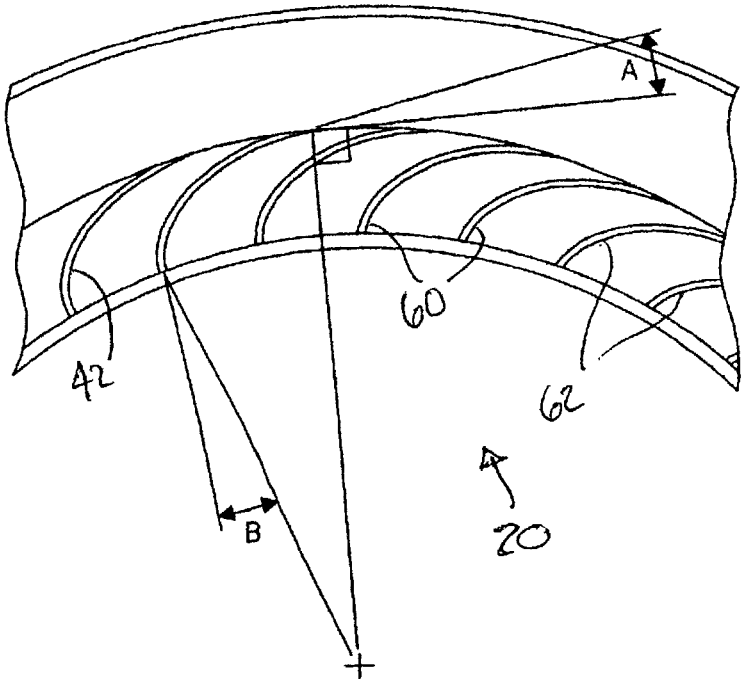

In a preferred embodiment, the guide vanes 42 are characterized by the following features: the dimension D-2 of the tip gap 36 ranges from ¼ inch to 1 inch, the inlet angle A ranges from 0 to 20 degrees, and the exit angle B ranges from −20 degrees to +20 degrees. See FIGS. 8-9.

In addition, the recirculation nozzle 30 can be characterized by the following features: the nozzle gap D-1 ranges from ⅛ inch to ½ inch, the overlap 24 of the shroud member 20 at the nozzle 30 ranges from 0.1 inch to 1 inch, and the nozzle angle C of the nozzle exit edge ranges from 0 degrees to 20 degrees.

A ring fan and shroud assembly constructed in accordance with the present teachings can provide a significantly improved pressure rise, together with stability and static efficiency. In general, the low relative momentum fluid trapped under the inside of the outer ring member 14 at the blade tips is energized and the recirculation flow is introduced back into the flow passage with the swirl removed. This helps to move the flow through the blade tip region and ensure that the recirculating flow encounters the leading edges of the blade members 12 aligned with the inlet angle A of the blade members 12.

The ring fan and shroud assembly 10 can be manufactured using a two-piece injection molding tool. It is not necessary to utilize expensively machined channels in the casing walls as apparently employed in some current compressor tip casing treatments.

While preferred embodiments of the present invention have been shown and described herein, numerous variations and alternative embodiments will occur to those skilled in the art. Accordingly, it is intended that the invention is not limited to the preferred embodiments described herein but instead limited to the terms of the appended claims.

What is claimed is:

1. A ring fan and shroud assembly comprising:

a fan having a hub with a plurality of projecting fan blades and an outer ring member;

a shroud member positioned around said outer ring member;

a recirculating flow member on said shroud member and positioned forward adjacent said outer ring member;

a plurality of curved guide vanes positioned within said recirculating flow member having an inlet angle substantially tangential with an outer entry diameter radial surface of said recirculating flow member and having an outlet angle substantially radial along an inner exit diameter of said recirculating flow member.

2. The ring fan and shroud assembly of claim 1, wherein said inlet angle is 20° or less.

3. The ring fan and shroud assembly of claim 1, wherein said outlet angle is plus or minus radial 20° or less.

4. The ring fan and shroud assembly of claim 1 wherein there are a prime number of said guide vanes.

5. The ring fan and shroud assembly of claim 1 wherein the spacing between at least two of said vanes is not equal to the spacing between two other said guide vanes.

6. The ring fan and shroud assembly of claim 1 wherein said recirculating flow member forms an inlet nozzle for said ring fan assembly.

7. The ring fan and shroud assembly of claim 1 wherein said guide vanes are integrally molded with said recirculating flow member.

8. The ring fan and shroud assembly of claim 1 wherein said guide vanes are injection molded.

9. The ring fan and shroud assembly of claim 1, wherein said guide vanes circumferentially angularly decrease in space therebetween from inlet to outlet.

10. The ring fan and shroud assembly of claim 1 wherein said shroud member comprises an exit member substantially parallel or coincident with the air flow being ejected from trailing edges.

11. The ring fan and shroud assembly of claim 1 wherein said recirculating flow member is positioned at an axial angle relative to said shroud member.

12. The ring fan and shroud assembly of claim 1 wherein the inner diameter of said recirculating flow member is dimensionally radially inward and axially forward of said ring member.

13. The ring fan and shroud assembly of claim 1 wherein said guide vanes have a curvilinear shape.

14. A ring fan and shroud assembly comprising:

a fan having a hub with a plurality of projecting fan blades and an outer ring member;

a shroud member positioned around said outer ring member;

a recirculating flow member positioned substantially axially forward adjacent said outer ring member, said recirculating flow member having outer entry and inner exit diameters radially dimensionally juxtaposed by an outer diameter of said outer ring member; and a plurality of curvilinear guide vanes positioned within said recirculating flow member having an inlet angle 20 degrees or less tangential with an outer diameter surface of said recirculating flow member and having an outlet angle 20 degrees plus or minus radial along an inner diameter surface of said recirculating flow member.

15. A ring fan and shroud assembly comprising:

a fan having a hub with a plurality of projecting fan blades, and an outer ring member;

a shroud member positioned around said outer ring member;

a recirculating flow member positioned substantially axially forward adjacent said outer ring member, an inner diameter of said recirculating flow member being greater than an outer diameter of said outer ring member; and a plurality of curvilinear guide vanes positioned within said recirculating flow member having an inlet angle 20 degrees or less with an outer entry diameter surface of said recirculating flow member and having an outlet angle plus or minus 20 degrees radial along an inner diameter surface of said recirculating flow member.

* * * * *